US009994016B2

(12) United States Patent
Kuwayama

(10) Patent No.: US 9,994,016 B2
(45) Date of Patent: Jun. 12, 2018

(54) LIQUID EJECTION DEVICE

(71) Applicant: Brother Kogyo Kabushiki Kaisha, Nagoya-shi, Aichi-ken (JP)

(72) Inventor: Tsuyoshi Kuwayama, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days. days.

(21) Appl. No.: 15/346,058

(22) Filed: Nov. 8, 2016

(65) Prior Publication Data

US 2017/0129238 A1 May 11, 2017

(30) Foreign Application Priority Data

Nov. 9, 2015 (JP) ..... 2015-219694

(51) Int. Cl.
*B41J 29/38* (2006.01)
*B41J 2/045* (2006.01)
*B41J 2/21* (2006.01)

(52) U.S. Cl.
CPC ..... *B41J 2/04573* (2013.01); *B41J 2/04505* (2013.01); *B41J 2/04586* (2013.01); *B41J 2/2132* (2013.01); *B41J 2/2135* (2013.01)

(58) Field of Classification Search
None
See application file for complete search history.

(56) References Cited

U.S. PATENT DOCUMENTS 5,576,744 A 11/1996 Niikura et al.
5,874,979 A 2/1999 Ohyama
2007/0097164 A1* 5/2007 Marumoto ..... B41J 29/38 347/15
2011/0175958 A1* 7/2011 Sato ..... B41J 19/142 347/14
2015/0273823 A1 10/2015 Kato et al.

FOREIGN PATENT DOCUMENTS

JP 3293707 B2 6/2002
JP 3313819 B2 8/2002
JP 2003251800 A 9/2003
JP 2008-230069 A 10/2008
JP 2015189095 A 11/2015

* cited by examiner

*Primary Examiner* — Matthew Luu
*Assistant Examiner* — Tracey McMillion
(74) *Attorney, Agent, or Firm* — Banner & Witcoff, Ltd.

(57) ABSTRACT

A liquid ejection device includes an ejection head having a plurality of nozzle groups, each of the plurality of nozzle groups including one nozzle or two or more nozzles arranged adjacent to each other, and a controller configured to determine an ejection timing each of the plurality of nozzle groups such that a first deviation amount in the main scanning direction between an first image and an second image on an medium is smaller than a second deviation amount in a main scanning direction between an area to be printed by an first nozzle group included the plurality of nozzle groups and an area to be printed by an second nozzle group adjacent to the first nozzle group.

14 Claims, 10 Drawing Sheets

LIQUID EJECTION DEVICE

CROSS-REFERENCE TO RELATED APPLICATION

This application claims priority from Japanese Patent Application No. 2015-219694 filed on Nov. 9, 2015, the content of which is incorporated herein by reference in its entirely.

BACKGROUND

In some conventional liquid ejection devices such as an inkjet printer, a liquid ejection device alternately executes a scanning operation of moving an ejecting head having a plurality of nozzles in a main scanning direction while causing the ejecting head to eject liquid droplets from the nozzles. These devices further provide a medium conveying operation of conveying a recording medium in a sub-scanning direction intersecting with the main scanning direction, while forming an image on the recording medium. In such liquid ejection devices, in a certain print mode, an image for the number of the nozzles arranged in the sub-scanning direction is formed in a path on the recording medium, and after the medium conveying operation, an adjacent image is formed in the next path. The scanning operation and the medium conveying operation are alternately repeated, and a predetermined image is formed on the recording medium.

In such a liquid ejection device, a shift may occur in the main scanning direction between the image formed in the previous path and the image formed in the next path. In some examples, such a shift between paths (inter-path shift) results from inclination of the nozzle surface of the ejecting head or the recording medium with respect to the sub-scanning direction, or a shift of the recording medium in the main scanning direction by the medium conveying operation. In the aforementioned liquid ejection devices, the nozzles of the ejecting head are divided into two nozzle groups in the sub-scanning direction, and liquid ejection timing is corrected to equalize an image shift between the two nozzle groups and an image shift between the paths.

SUMMARY

A shift resulting from each scan of the ejecting head, such as the above-described inter-path shift, may be divided into or attributed to a steady component with repetitive reproducibility and a component having a variation (variation component) without repetitive reproducibility. For example, the inclination of the nozzle surface of the ejecting head or the recording medium with respect to the sub-scanning direction may be generated when the ejecting head or a platen or the like that supports the recording medium is assembled. The inclination is constant in accordance with the assembled state; however, the inclination may vary every scanning operation or medium conveying operation. Also, for example, when an image is formed by ejecting liquid droplets on a recording medium by scanning with a certain ejecting head and an image is formed in the next scanning at a position adjacent to the former image, the recording medium may swell from the liquid droplets ejected in the previous scanning, and the shape of the recording medium may change in the next scanning. The above-described variation component is a result of the positional relationship between the ejecting head and the recording medium varying each time the ejecting head performs scanning. The correction on the ejection timing of the liquid ejection device described in Japanese Unexamined Patent Application Publication No. 2008-230069 does not consider the above-described variation component. Hence, the maximum total shift amount in the image is potentially larger than the expected shift for the amount of the variation component.

Accordingly, aspects described herein provide an improved liquid ejection device, method and system that decreases the maximum image shift in an image formed on a recording medium.

DETAILED DESCRIPTION

A liquid ejection device according to an embodiment is described below with reference to the drawings.

Configuration of Liquid Ejection Device

Figure 1:
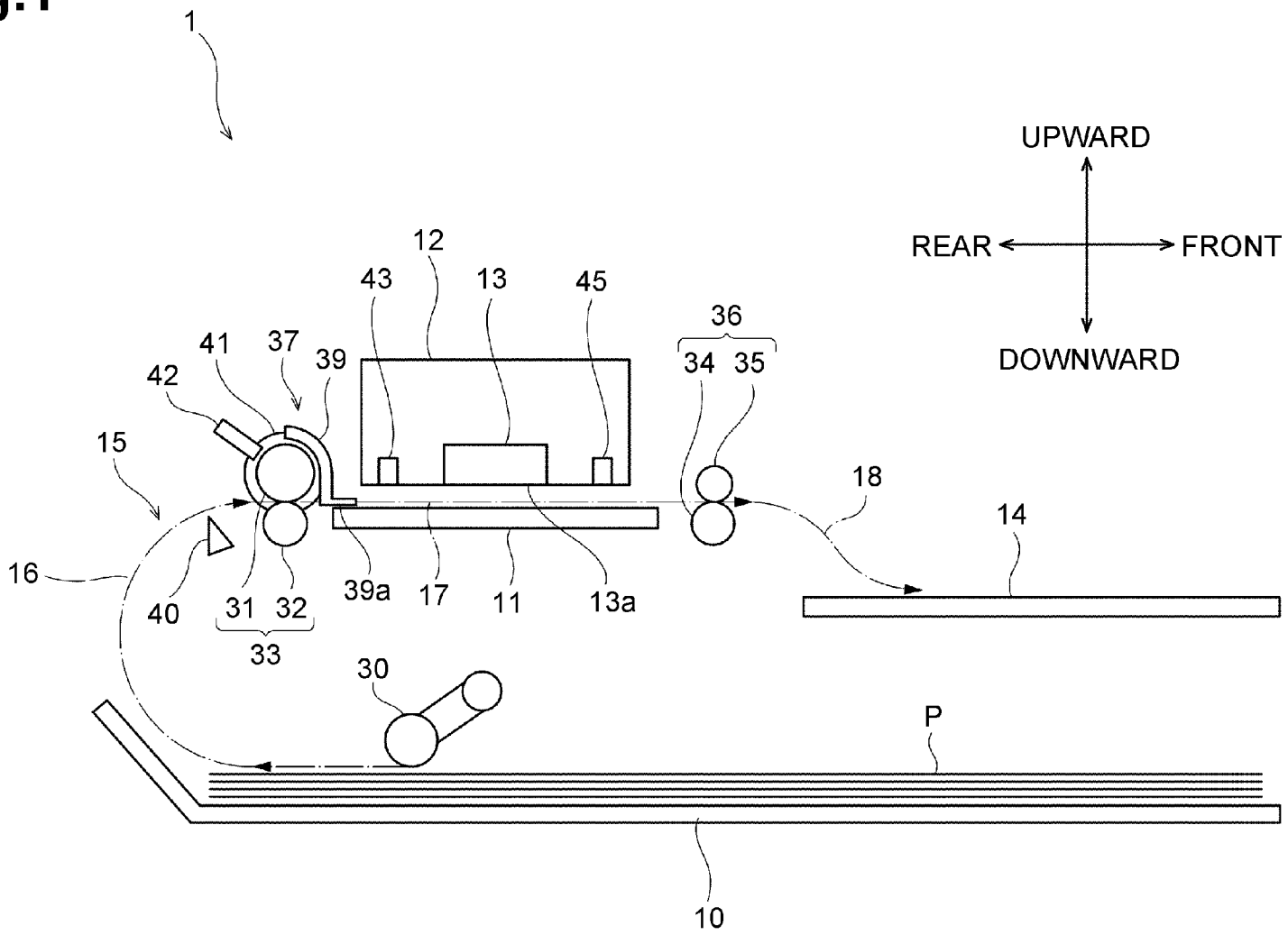
FIG. 1 is a schematic view showing an outline configuration of a liquid ejection device according to an embodiment.

FIG. 1 is a schematic view showing an outline configuration of a liquid ejection device 1 according to an embodiment. The liquid ejection device 1 is, for example, an inkjet printer. As shown in FIG. 1, the liquid ejection device 1 includes a feed tray 10 that supports a plurality of recording media P. A plate-shaped platen 11 is provided above the feed tray 10. The platen 11 has a long length in the left-right direction. A carriage 12 for scanning in a main scanning direction is provided above the platen 11. An ejecting head 13 and other components are mounted on the carriage 12. The ejecting head 13 ejects liquid droplets and forms an image on a recording medium P. Also, a discharge tray 14 is provided at the front of the platen 11. The discharge tray 14 receives the recording medium P after recording.

A medium conveying path 15 extends from the rear of the feed tray 10. The medium conveying path 15 includes a curved portion 16, a straight portion 17, and a discharge unit 18. The curved portion 16 extends upward from the feed tray 10, is curved forward, and extends to a position near the rear of the platen 11. The straight portion 17 extends forward from the endpoint of the curved portion 16 in an area immediately above the platen 11, and extends to a position near the front of the platen 11. The discharge unit 18 extends from the endpoint of the straight portion 17 to the discharge tray 14.

The liquid ejection device 1 includes a feed roller 30, a convey roller 31, and other components, as a convey mechanism for conveying the recording medium P along the medium conveying path 15. To be specific, the feed roller 30 is provided immediately above the feed tray 10. The feed roller 30 feeds the recording medium P in the feed tray 10 to the medium conveying path 15. Also, a convey roller unit 33 is arranged near the downstream end of the curved portion 16. The convey roller unit 33 includes the convey roller 31 and a pinch roller 32. The convey roller unit 33 is provided to pinch the recording medium P, which is fed to the medium conveying path 15 by the feed roller 30, with both the rollers 31 and 32 from the upper and lower sides. A waveform applying mechanism 37 is provided near the upstream end of the straight portion 17. The waveform applying mechanism 37 applies a wave shape to the recording medium P while the recording medium P passes through the straight portion 17 (in other words, while the recording medium P faces a nozzle surface 13*a*).

Further, a discharge roller unit 36 is arranged near the downstream end of the straight portion 17. The discharge roller unit 36 includes a discharge roller 34 and a spur roller 35. The discharge roller unit 36 is provided to pinch the recording medium P, which is fed in the straight portion 17 by the convey roller unit 33, with both the rollers 34 and 35 from the upper and lower sides.

Accordingly, the recording medium P in the feed tray 10 is fed by the feed roller 30 to the medium conveying path 15 (the curved portion 16). The recording medium P on the curved portion 16 is conveyed by the convey roller unit 33 to the straight portion 17, and an image is recorded on the recording medium P with liquid droplets ejected from the ejecting head 13. The recording medium P after recording on the straight portion 17 is conveyed by the discharge roller unit 36 to the discharge unit 18, and is housed in the discharge tray 14.

The liquid ejection device 1 is provided with various sensors. For example, a registration sensor 40 is provided immediately before (near the upstream side of) the convey roller unit 33 in the medium conveying path 15. The registration sensor 40 is a sensor for causing a controller 60 (the details will be described later) to detect the leading edge position of the recording medium P. Also, a rotary encoder 41 is coaxially provided at the convey roller 31. A rotary encoder sensor 42 is provided near the rotary encoder 41. The rotary encoder sensor 42 causes the controller 60 to detect the rotation angle of the convey roller 31.

A media sensor 43 is mounted on a lower surface of a rear portion of the carriage 12. In some examples, the media sensor 43 includes an optical sensor or the like. The media sensor 43 causes the controller 60 to detect the left and right edge positions of the recording medium P conveyed in the medium conveying path 15. Further, a linear encoder sensor 45 is mounted on a lower surface of a front portion of the carriage 12. The linear encoder sensor 45 reads an index applied to a linear scale (not shown) provided along the scanning direction of the carriage 12, and causes the controller 60 to detect the position in the scanning direction of the carriage 12.

Figure 2:
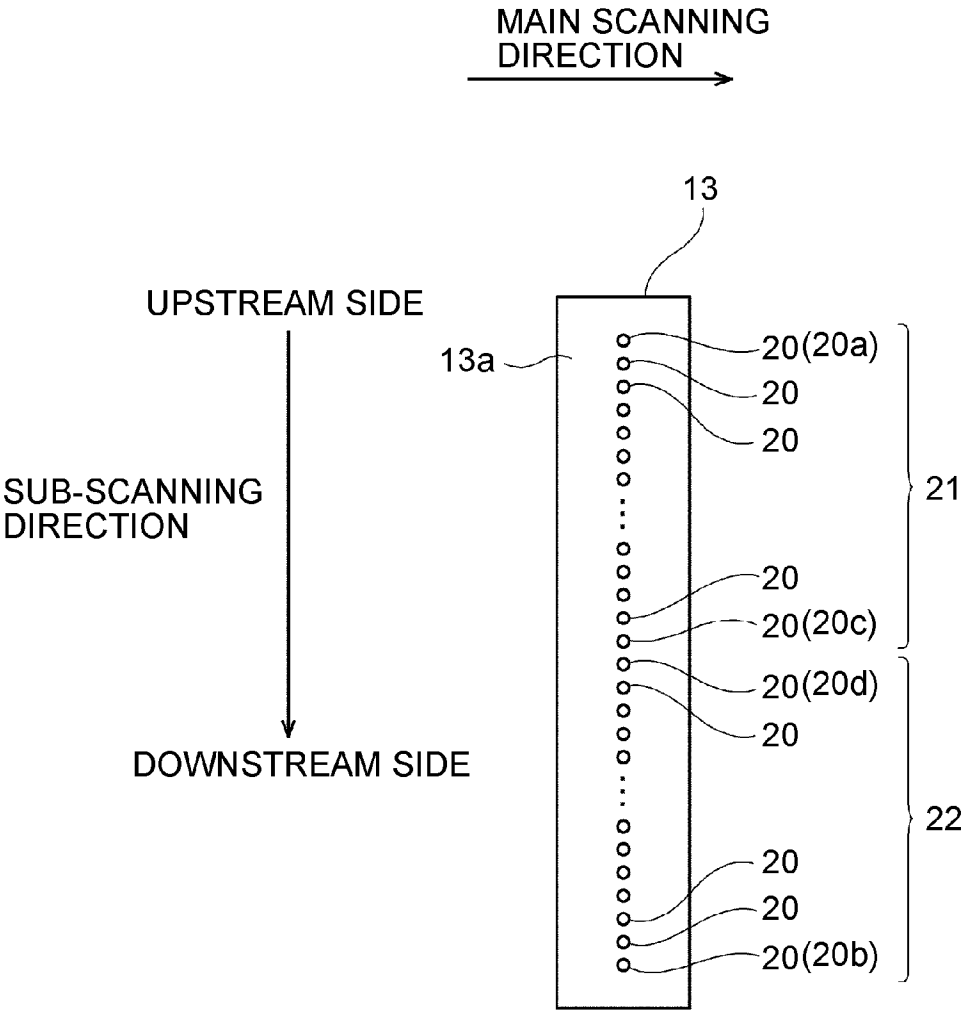
FIG. 2 is a plan view of an ejecting head of the liquid ejection device in FIG. 1.

FIG. 2 is a plan view of the ejecting head 13 mounted on the carriage 12 of the liquid ejection device 1. As shown in FIG. 2, the ejecting head 13 has a plurality of nozzles 20 that eject liquid droplets and the nozzle surface 13*a* with the nozzles 20 being open. In the nozzle surface 13*a* of the ejecting head 13, one nozzle or two or more continuous nozzles arranged in a sub-scanning direction intersecting with the main scanning direction (that is, a medium conveying direction) form a nozzle group, and a number N (N≥2) of the nozzle groups are continuously arranged in the sub-scanning direction. In this embodiment, as shown in FIG. 2, the nozzles 20 are arranged linearly in the sub-scanning direction. The ejecting head 13 has two (N=2) nozzle groups (a first nozzle group 21 and a second nozzle group 22) each having an equivalent number of the nozzles 20 equally divided in the sub-scanning direction. However, the nozzles 20 do not have to be arranged linearly, and may be arranged in, for example, a staggered manner. The first nozzle group 21 is a first nozzle group in the sub-scanning direction, and is located in the upstream half section in the sub-scanning direction. The second nozzle group 22 is a second nozzle group in the sub-scanning direction, and is located in the downstream half section in the sub-scanning direction. The first nozzle group 21 and the second nozzle group 22 are driven by different head driver integrated circuits (ICs) 69*a* and 69*b* (see FIG. 4). Hence, the controller 60 (described later) determines the ejection timing of liquid droplets for each of the nozzle groups 21 and 22 on the basis of print data.

Figure 3A:
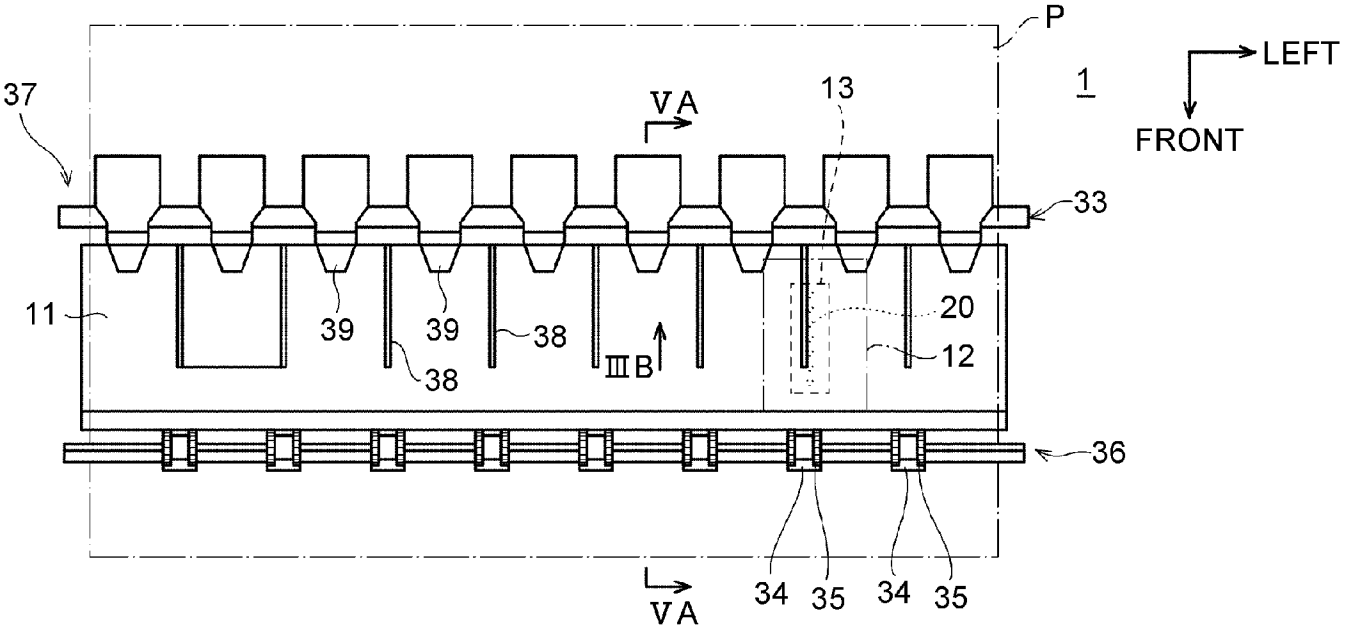
FIG. 3A is a partial outline plan view of the liquid ejection device in FIG. 1.
Figure 3B:
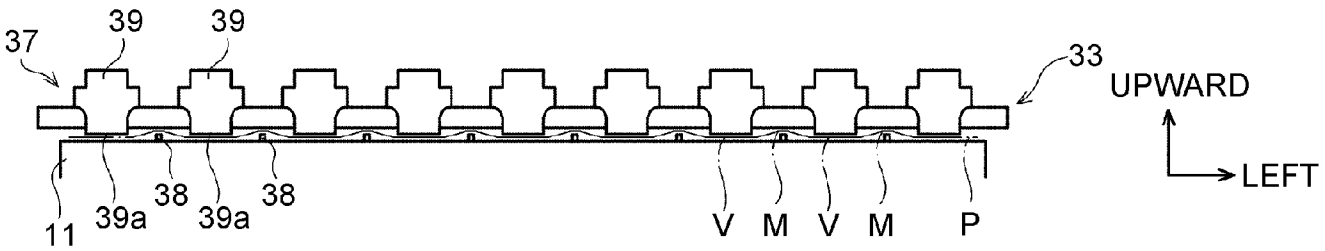
FIG. 3B is a view taken along arrow IIIB in FIG. 3A.

FIG. 3A is a partial outline plan view of the liquid ejection device in FIG. 1. FIG. 3B is a view taken along arrow IIIB in FIG. 3A. As shown in FIGS. 3A and 3B, in this embodiment, the waveform applying mechanism 37 includes a plurality of ribs 38 and a plurality of corrugated plates 39. As shown in FIG. 3A, the ribs 38 and the corrugated plates 39 are arranged in the left-right direction. As shown in FIG. 3B, each of the ribs 38 is formed to protrude upward from the upper surface of the platen 11 and extends rearward from a front end portion of the upper surface. The corrugated plates 39 are engaged by a guide rail (not shown). The corrugated plates 39 are formed to extend from the engaged portion to the lower front while being curved along the outer peripheral surface of the convey roller 31. The corrugated plates 39 have plate-shaped press portions 39*a* extending in the horizontal direction at distal ends extending to the lower front. The lower surfaces of the press portions 39*a* press the upper surface of the recording medium P supported by the platen 11.

As shown in FIG. 3B, when the recording medium P reaches the front end of the platen 11, the recording medium P is supported from the lower side with the upper edges of the ribs 38 and pressed from the upper side with the lower surfaces of the press portions 39*a*. The ribs 38 and the corrugated plates 39 are alternately arranged in the left-right direction. The lower surfaces of the press portions 39*a* are located at lower positions than the upper edges of the ribs 38. Hence, a wave shape is applied to the recording medium P. The wave shape includes a predetermined number of mountain portions M supported by the upper edges of the ribs 38 and a predetermined number of valley portions V located between the press portions 39*a* and the platen 11. The mountain portions M and the valley portions V are alternately arranged in the left-right direction.

Figure 4:
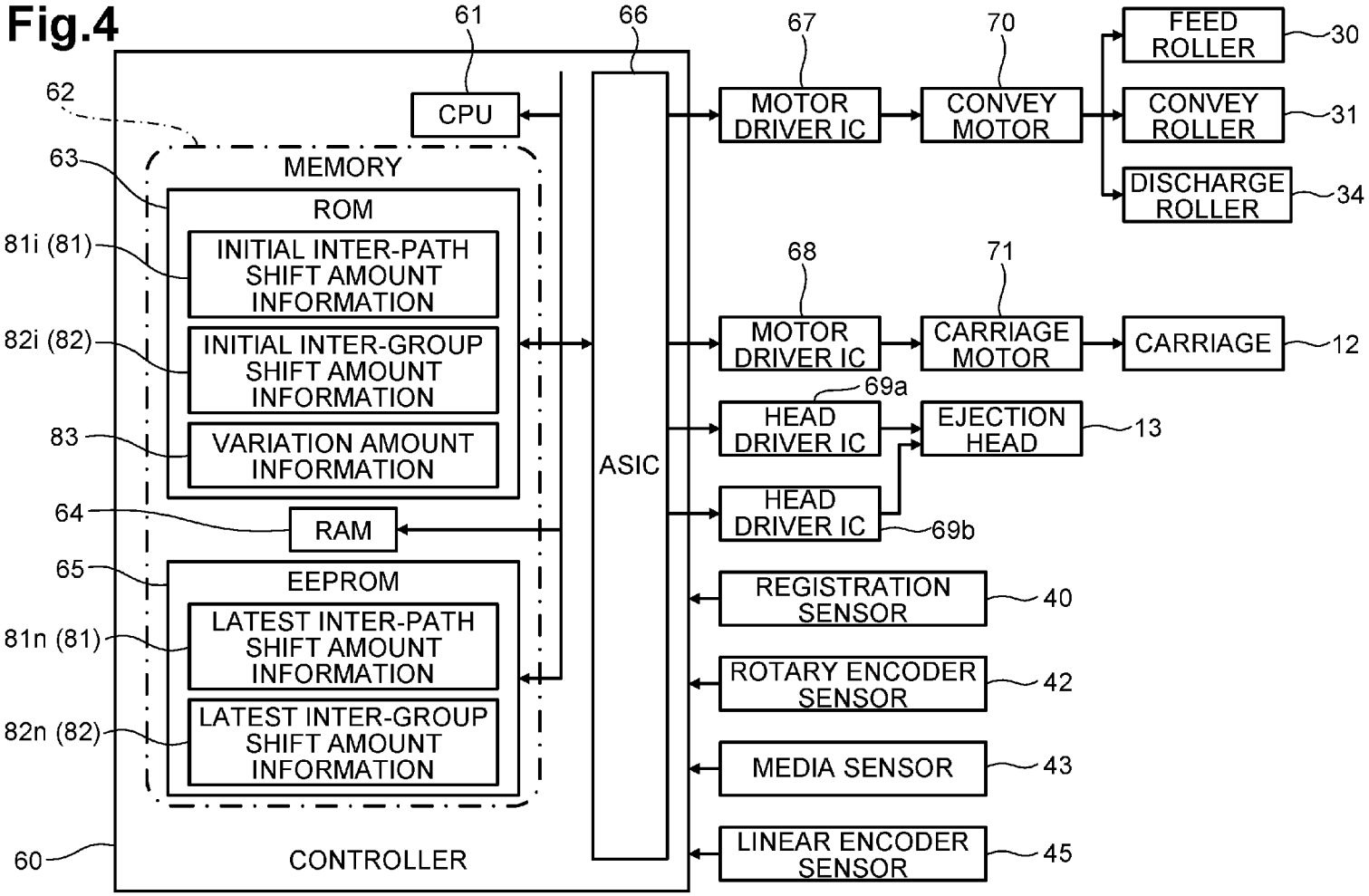
FIG. 4 is a block diagram showing a functional configuration of the liquid ejection device in FIG. 1.

FIG. 4 is a block diagram showing a further configuration of the liquid ejection device 1. As shown in FIG. 4, the liquid ejection device 1 includes the controller 60. The controller 60 includes a central processing unit (CPU) 61, a memory 62, and an application-specific integrated circuit (ASIC) 66. The memory 62 includes a read-only memory (ROM) 63, a random-access memory (RAM) 64, and an electrically erasable programmable ROM (EEPROM) 65. The ROM 63 stores various programs that are executed by the CPU 61. The RAM 64 is used for a storage area that temporarily stores data and signals used in execution of a program by the CPU 61. The EEPROM 65 stores setting, a flag, or data to be held even after the power of the liquid ejection device 1 is turned off. The memory 62 holds inter-path shift amount information 81, inter-group shift amount information 82, and variation amount information 83, which will be described in further detail below.

Two motor driver ICs 67 and 68 and two head driver ICs 69*a* and 69*b* are connected to the ASIC 66. When the CPU 61 receives an input of a print job from a user or other communication device through an input unit (not shown), the CPU 61 outputs an instruction for execution of the print job to the ASIC 66 on the basis of a program stored in the ROM 63. The ASIC 66 drives the respective driver ICs 67 to 69*b* on the basis of this instruction, and executes print processing.

The motor driver IC 67 drives a convey motor 70 to operate the feed roller 30, the convey roller 31, and the discharge roller 34. The motor driver IC 68 drives a carriage motor 71 to move the carriage 12 back and forth in the main scanning direction. The head driver IC 69*a* drives the first nozzle group 21 located at the upstream side in the medium conveying direction of the ejecting head 13 to cause the first nozzle group 21 to eject liquid droplets. The head driver IC 69*b* drives the second nozzle group 22 located at the downstream side in the medium conveying direction of the ejecting head 13 to cause the second nozzle group 22 to eject liquid droplets.

Also, the controller 60 receives inputs of signals output from the respective sensors including the registration sensor 40, the rotary encoder sensor 42, the media sensor 43, and the linear encoder sensor 45. The controller 60 drives the respective driver ICs 67 to 69*b* on the basis of these input signals to form an image on a recording medium P.

FIG. 4 shows the example in which the controller 60 includes only the single CPU 61. However, the controller 60 is not limited to the configuration in which processing is collectively executed by the single CPU 61. The controller 60 may include a plurality of CPUs 61, and the processing may be assigned to and executed by the plurality of CPUs 61. Also, FIG. 4 shows the example in which the controller 60 includes only the single ASIC 66. However, the controller 60 is not limited to the configuration in which processing is collectively executed by the single ASIC 66. The controller 60 may include a plurality of ASICs 66, and the processing may be assigned to and executed by the plurality of ASICs 66.

Inter-Path Shift Amount

Figure 5A:
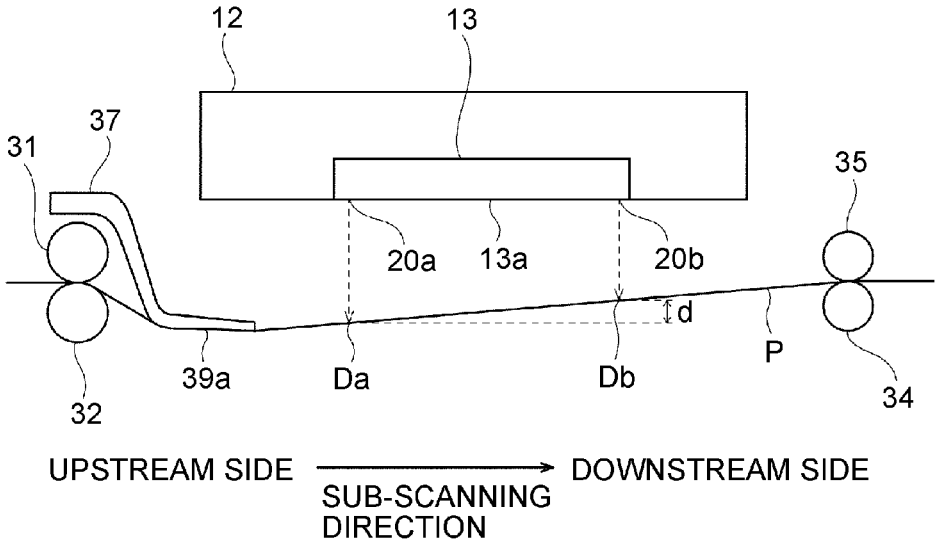
FIG. 5A is a view showing a cross-sectional view taken along line VA-VA in FIG. 3A.
Figure 5B:
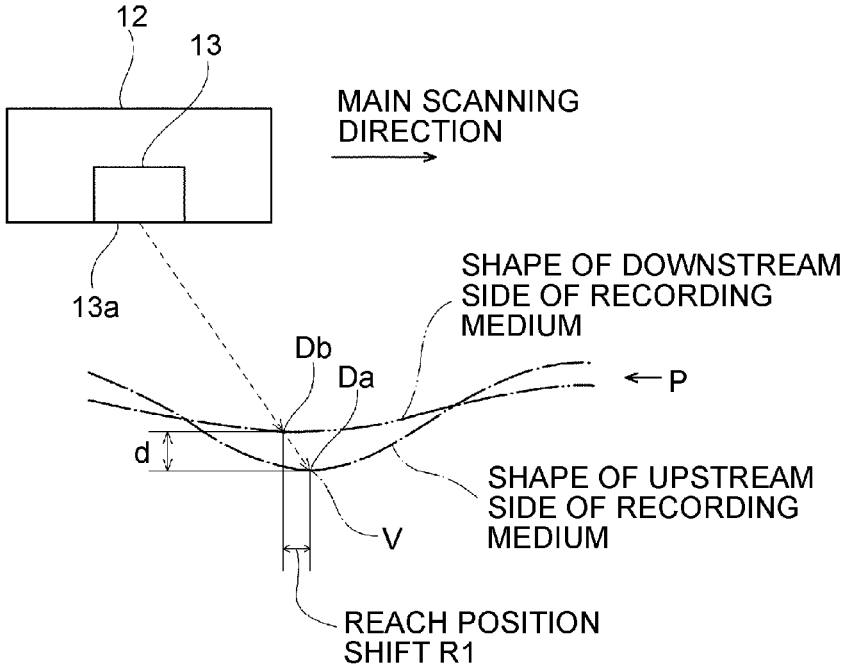
FIG. 5B is a view for describing a reach position shift resulting from a difference in distances of nozzles to a recording medium.

Before describing processing for image formation executed by the controller 60 of the liquid ejection device 1 according to this embodiment, hereinafter, an inter-path shift is described first with reference to FIGS. 5A, 5B, and 6. FIG. 5A briefly shows a cross-sectional view taken along line VA-VA in FIG. 3A. FIG. 5B briefly shows a state in which liquid droplets reach a recording medium P when viewed in the medium conveying direction. In the liquid ejection device 1, the controller 60 causes the ejecting head 13 to eject liquid droplets downward at the ejection timing determined by the controller 60 and to make the liquid droplets reach a target reach position of the recording medium P while causing the carriage 12 to move in the left-right direction. The ejected liquid droplets obliquely fly in the moving direction of the ejecting head 13 by inertia (see FIG. 5B). To make the liquid droplets reach the target reach position (e.g., in the main scanning direction), the nozzles 20 need to eject the liquid droplets before the nozzles 20 reach the position immediately above the target reach position based on a liquid droplet fly time and/or a liquid droplet fly distance in the left-right direction.

The inter-path shift is divided into a steady component with repetitive reproducibility and a variation component without repetitive reproducibility. For example, the inclination of the nozzle surface 13*a* of the ejecting head 13 or the recording medium P with respect to the sub-scanning direction generated when the ejecting head 13 or the platen 11 is assembled generates a shift having a constant tendency corresponding to the inclination (that is, the steady component of the inter-path shift) between paths. For example, in this embodiment, since the above-described waveform applying mechanism 37 is provided only at the upstream side between the convey roller unit 33 and the discharge roller unit 36, the applied wave shape of the recording medium P may decrease as the recording medium moves farther away from the press portion 39*a*. FIG. 5A shows a state in which the distance to the recording medium P (e.g., in an ejection direction) is gradually decreased from a nozzle 20*a* at the upstream end toward a nozzle 20*b* at the downstream end among the plurality of nozzles 20 arranged in the sub-scanning direction. For example, as shown in FIG. 5B, if the target reach position of a liquid droplet ejected from the nozzle 20*a* at the upstream end is set at a valley portion V, when the nozzle 20*a* at the upstream end and the nozzle 20*b* at the downstream end are compared with each other, the distance from the nozzle 20*b* at the downstream end to a recording medium P is smaller than the distance from the nozzle 20*a* at the upstream end to the recording medium P (see reference sign d in FIGS. 5A and 5B). Owing to this, a reach position shift $R_1$ is generated in the main scanning direction between a reach position Da of a liquid droplet from the nozzle 20*a* at the upstream end and a reach position Db of a liquid droplet from the nozzle 20*b* at the downstream end. This shift $R_1$ is a steady component of the inter-path shift.

In contrast, each time the ejecting head 13 performs scanning, the positional relationship between the ejecting head 13 and the recording medium P (the positional relationship includes the orientation of the ejecting head 13 with respect to the recording medium P) may vary, and the shape of the recording medium P may change by swelling. This may generate a variation component $R_2$ of the inter-path shift. FIG. 6 shows an image shift when a line image parallel to the medium conveying direction is formed on a recording medium P without execution of the ejection timing determination processing by the controller 60 (described later). As shown in FIG. 6, an image formed in each path (in FIG. 6, n-th path and n+1-th path) is formed obliquely with respect to the conveying direction due to the inclination between the nozzle surface and the recording medium generated at a time of assembly as shown in FIG. 5A. This generates a shift $R_1$ between two adjacent images formed in respective paths. However, the actual inter-path shift amount may include the above-described variation component $R_2$ added to the shift $R_1$ being the steady component. FIG. 6 shows, in addition to the actual reach position in the n+1-th path, a reach position in the n+1-th path influenced only by the steady component $R_1$ using dotted lines for comparison. By the influence of this variation component $R_2$, the maximum shift amount in the image formed on the recording medium P is larger than the case influenced only by the steady component $R_1$. Hereinafter, processing that is executed by the controller 60 to decrease the above-described maximum image shift is described.

Execution Processing in Controller 60

Figure 7:
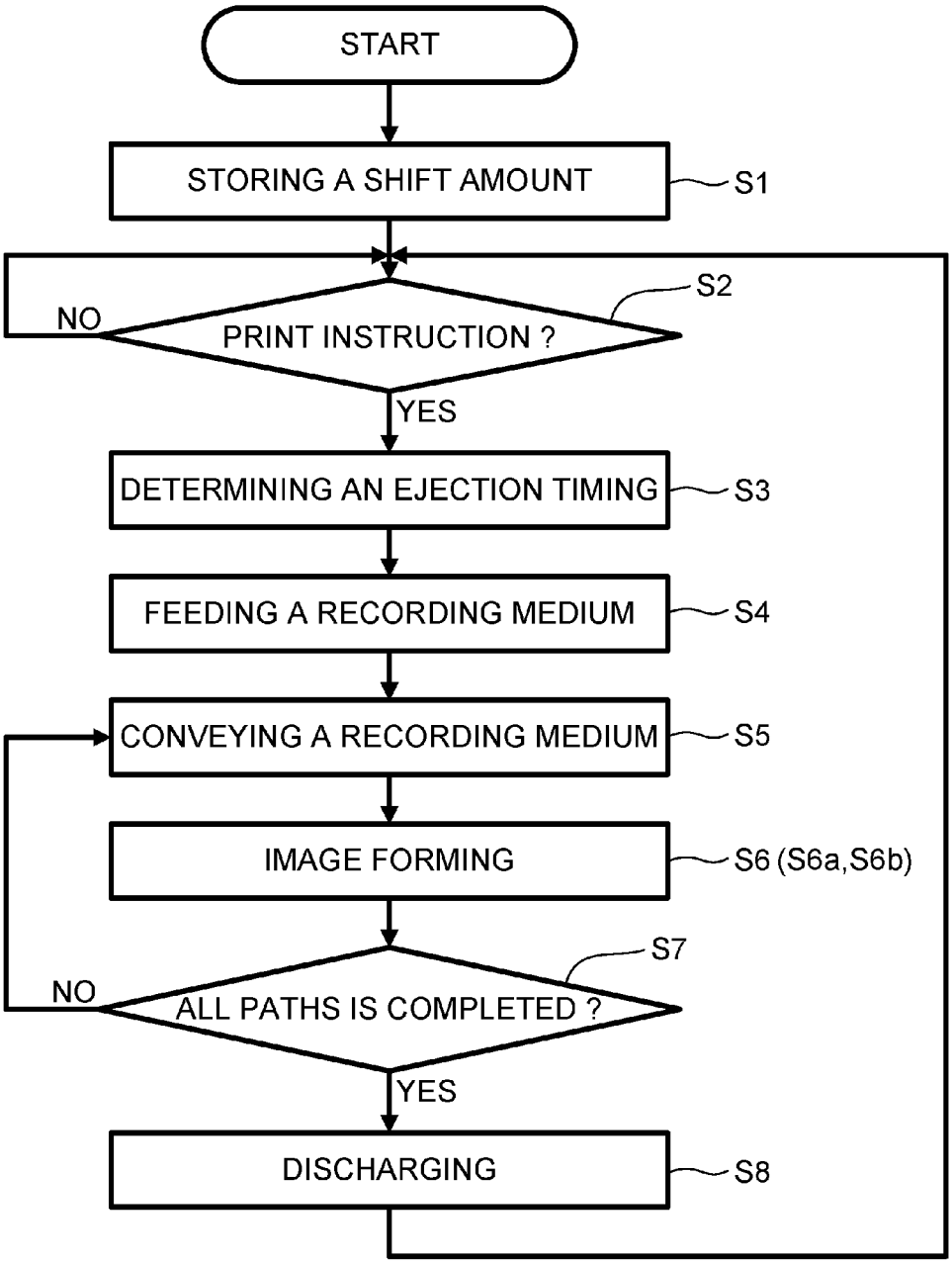
FIG. 7 is a flowchart showing an example of processing that is executed by a controller shown in FIG. 4.

FIG. 7 is a flowchart showing an example of processing that is executed by the controller 60. In the liquid ejection device 1 of this embodiment, the memory 62 of the controller 60 stores information relating to a predetermined image shift amount in advance of any image formation being executed on a recording medium P (S1). Although described in further detail below, step S1 may be executed in a factory or may be executed by a user after the liquid ejection device 1 is manufactured in some examples. The controller 60 waits for a print instruction while a print instruction is not present (S2: NO). If the controller 60 determines that a print instruction is present (S2: YES), the controller 60 determines an ejection timing of liquid droplets for each of the nozzle groups 21 and 22 on the basis of print data and the information stored in the memory 62 (S3). Also, the controller 60 activates the feed roller 30, and executes feed processing (S4) of feeding a recording medium P from the feed tray 10 to the straight portion 17 (S4).

If the controller 60 determines that the leading edge of the recording medium P reaches the convey roller unit 33 on the basis of the signal from the registration sensor 40, the controller 60 activates the convey roller unit 33 and the discharge roller unit 36 while monitoring the signal from the rotary encoder sensor 42, and repeats conveyance processing of conveying the recording medium P (S5) and image formation processing for one path (S6) until image formation for all paths is completed (S7: NO). To be more specific, the controller 60 causes the ejecting head 13 to eject liquid droplets at the ejection timing determined in the ejection timing determination processing S3 while causing the ejecting head 13 to perform scanning in the main scanning direction, to form an image for one path (corresponding to a first image according to an embodiment) on the recording medium P (S6*a*) (corresponding to first image formation processing according to an embodiment). Then, the controller 60 causes the recording medium P to be conveyed for or advanced by one path (S5). Then, the controller 60 causes the ejecting head 13 to eject liquid droplets at the ejection timing determined in the ejection timing determination processing S3 while causing the ejecting head 13 to perform scanning in the main scanning direction, to form an image for the next path (corresponding to a second image) at a position adjacent to the image formed in the previous path of the recording medium P in the sub-scanning direction (S6*b*) (corresponding to second image formation processing). In this way, when the operation of forming an image in the next path is sequentially executed at a position adjacent to the image formed in the previous path, if image formation for all paths is completed (S7: YES), the controller 60 activates the discharge roller unit 36, and executes discharge processing of causing the recording medium P to be discharged to the discharge tray 14 (S8).

The information stored in advance in the memory 62 before the image formation is executed in aforementioned step S1 is a shift amount I specific to the liquid ejection device 1 on a device basis. In this embodiment, in step S1, the inter-path shift amount information 81, the inter-group shift amount information 82, and the variation amount information 83 are stored in the memory 62 of the controller 60 (see FIG. 4). Among these pieces of information, the inter-path shift amount information 81 and the inter-group shift amount information 82 correspond to information relating to the device specific shift amount I. Hereinafter, the information relating to the device specific shift amount I stored in the memory 62 is described in further detail.

In this case, the inter-path shift amount information 81 is information relating to an inter-path shift amount A. The inter-path shift amount A is a shift amount in the main scanning direction between two adjacent images formed in respective paths. To be more specific, the inter-path shift amount A (corresponding to a first shift amount) is a shift amount in the main scanning direction between a reach direction of a liquid droplet ejected from the nozzle 20*a* at the upstream end in a certain path and a reach position of a liquid droplet ejected from the nozzle 20*b* at the downstream end in the next path.

Also, the inter-group shift amount information 82 is information relating to an inter-group shift amount B. The inter-group shift amount B (corresponding to a second shift amount) is a shift amount in the main scanning direction between images formed in the same path by two certain adjacent nozzle groups. In this embodiment, since the ejecting head 13 includes the two nozzle groups 21 and 22, the inter-group shift amount B is a shift amount $B_1$ in the main scanning direction between images formed in the same path by the first nozzle group 21 and the second nozzle group 22. To be specific, the inter-group shift amount $B_1$ is a shift amount in the main scanning direction between a reach position Dc (see FIG. 6) of a liquid droplet from a nozzle 20*c* at the downstream end of the first nozzle group 21 and a reach position Dd (see FIG. 6) of a liquid droplet from a nozzle 20*d* at the upstream end of the second nozzle group 22.

Figure 6:
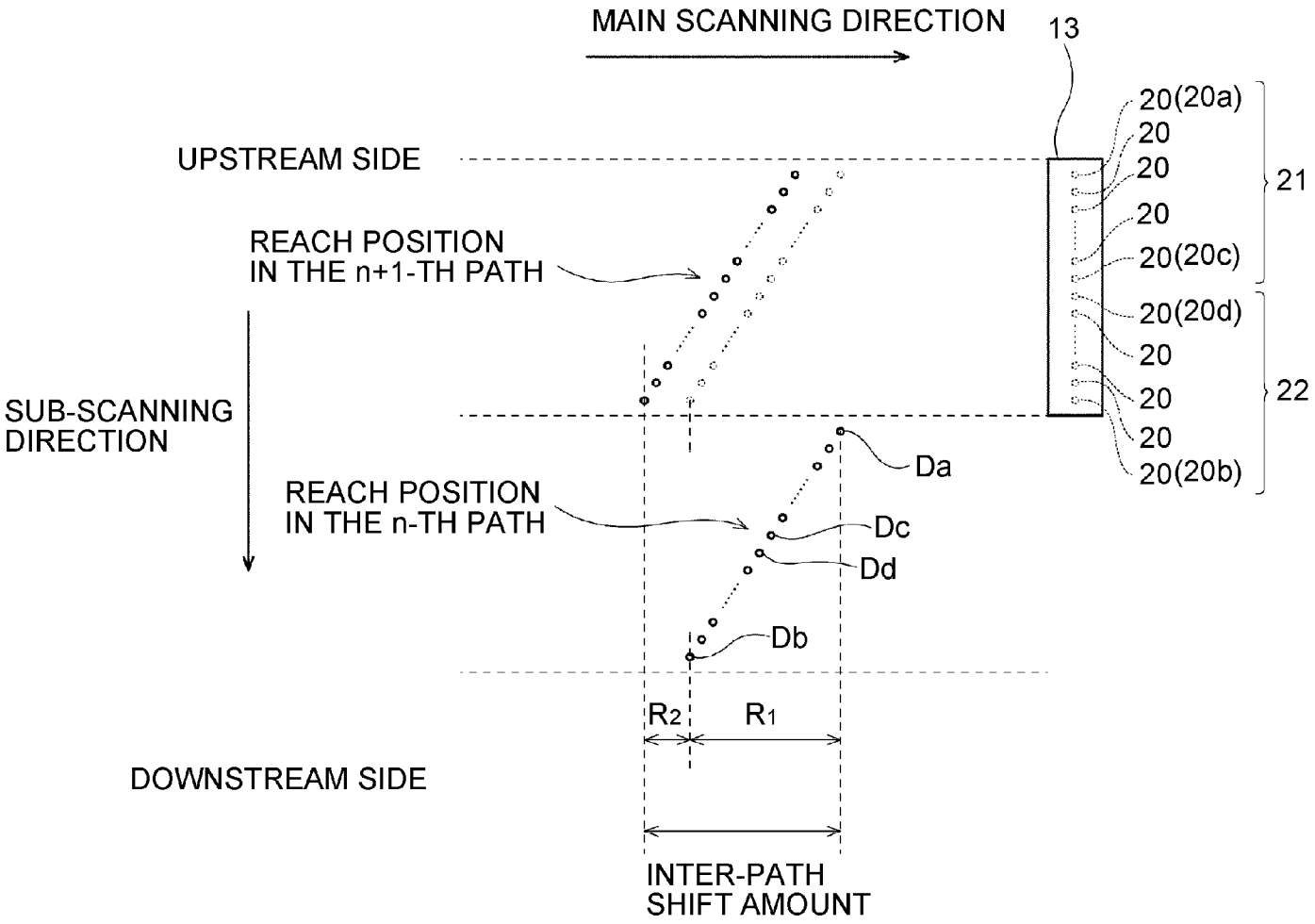
FIG. 6 is a view illustrating a shift between two adjacent images formed in respective paths.

If ejection timings of respective nozzle groups are controlled so that ejection timings of adjacent nozzle groups are the same, for example, as shown in FIG. 6, the inter-group shift amount B is very small as compared with the inter-path shift amount A, and hence, the inter-group shift amount B can be assumed as or defined as 0. The inter-group shift amount information 82 includes information relating to an inter-group shift amount B of nozzle groups for the total number of nozzle groups−1, that is, a number N−1. In this embodiment, the inter-group shift amount information 82 includes information relating to one inter-group shift amount $B_1$ between the first nozzle group 21 and the second nozzle group 22.

Also, the variation amount information 83 is information relating to a variation amount C. The variation amount C is the maximum estimated amount of a shift in the main scanning direction of the recording medium P by the medium conveying operation. In other words, the variation amount C is the maximum estimated amount of the difference between a target amount At of an inter-path shift amount (e.g., pre-calculated based on the orientation of the ejecting head 13) and an inter-path shift amount Am that may be actually generated. The variation amount C is a standard deviation when the difference between the target amount At of the inter-path shift amount and the inter-path shift amount Am that may be actually generated is actually measured a plurality of times after the liquid ejection device 1 is manufactured.

The inter-path shift amount information 81 may include initial inter-path shift amount information 81*i* and latest inter-path shift amount information 81*n* (see FIG. 4). The initial inter-path shift amount information 81*i* is information indicative of an initial value of the inter-path shift amount A. For example, the initial inter-path shift amount information 81*i* is a factory shipment value permanently stored in a first area (for example, the ROM 63) of the memory 62 in the factory after the liquid ejection device 1 is manufactured.

Also, the latest inter-path shift amount information 81*n* is information indicative of the latest value of the inter-path shift amount A. The latest inter-path shift amount information 81*n* is acquired by the controller 60 at maintenance work or the like after the liquid ejection device 1 is shipped, and is updated and stored in a second area (for example, the EEPROM 65) of the memory 62. However, the inter-path shift amount information 81 may be only one of the initial inter-path shift amount information 81*i* and the latest inter-path shift amount information 81*n*, and the initial inter-path shift amount information 81*i* may not be permanently stored and may be overwritten. If the memory 62 includes both the initial inter-path shift amount information 81*i* and the latest inter-path shift amount information 81*n*, the latest inter-path shift amount information 81*n* is used with higher priority in the ejection timing determination processing S3.

Also, the inter-group shift amount information 82 may include initial inter-group shift amount information 82*i* and latest inter-group shift amount information 82*n* (see FIG. 4). The initial inter-group shift amount information 82*i* is information indicative of an initial value of the inter-group shift amount B. For example, the initial inter-group shift amount information 82*i* is a factory shipment value permanently stored in the first area (for example, the ROM 63) of the memory 62 in the factory after the liquid ejection device 1 is manufactured. Also, the latest inter-group shift amount information 82*n* is information indicative of the latest value of the inter-group shift amount B. The latest inter-group shift amount information 82*n* is acquired at maintenance work or the like after the liquid ejection device 1 is shipped, and is updated and stored in the second area (for example, the EEPROM 65) of the memory 62. However, the inter-group shift amount information 82 may be only one of the initial inter-group shift amount information 82*i* and the latest inter-group shift amount information 82*n*, and the initial inter-group shift amount information 82*i* may not be permanently stored and may be overwritten. If the memory 62 includes both the initial inter-group shift amount information 82*i* and the latest inter-group shift amount information 82*n*, the latest inter-group shift amount information 82*n* is used with higher priority in the ejection timing determination processing S3.

The inter-path shift amount information 81, inter-group shift amount information 82, and variation amount information 83 are obtained, for example, by forming an image (for example, a plurality of ruled lines along the sub-scanning direction) on a recording medium P by the liquid ejection device 1, and measuring the respective shift amounts A, B, and C generated in the formed image. At this time, the shift amounts A, B, and C may be measured by a device different from the liquid ejection device 1. In this case, the respective measured shift amounts A, B, and C are input to the controller 60 through a predetermined input device, and the respective pieces of information 81 to 83 are held in the memory 62 of the controller 60. Also, in measuring the respective shift amounts A, B, and C, if the liquid ejection device 1 includes a shift amount detector for detecting the shift amounts A, B, and C, the respective shift amounts A, B, and C may be acquired by the shift amount detector. The respective pieces of information 81 to 83 relating to the acquired shift amounts A, B, and C may be automatically held in the memory 62 of the controller 60. As the shift amount detector, for example, the media sensor 43 mounted on the carriage 12 is used. Also, if the liquid ejection device 1 is a printer with a scanner, the scanner may be used as the shift amount detector.

As described above, the inter-path shift amount information 81 and the inter-group shift amount information 82 correspond to information relating to the device specific shift amount I. The device specific shift amount I is an amount obtained by adding the inter-path shift amount A included in the inter-path shift amount information 81 and the sum total ($B_{ALL}$) of inter-group shift amounts ($B_1$) included in the inter-group shift amount information 82 (that is, $I=A+B_{ALL}$). The information relating to the device specific shift amount I does not have to be plural pieces of information such as the inter-path shift amount information 81 and the inter-group shift amount information 82, and may be a single piece of information as long as the device specific shift amount I can be restored. For example, the information relating to the device specific shift amount I may be information relating to the inter-path shift amount A generated when liquid droplets are ejected so that any of inter-group shift amounts is zero (that is, $B_i=0$).

In the ejection timing determination processing S3, the controller 60 sets a target amount At of the inter-path shift amount (corresponding to a first target amount according to the invention) and a target amount Bt of the inter-group shift amount (corresponding to a second target amount) on the basis of the information relating to the device specific shift amount I. To be specific, the controller 60 determines the ejection timing so that the target amount Bt of the inter-group shift amount is larger than the target amount At of the inter-path shift amount. The ejection timing determination processing S3 is described below in detail.

The added amount of the target amount At of the inter-path shift amount and the sum total of the target amounts Bt of the inter-group shift amounts corresponds to the device specific shift amount I. Further, the controller 60 sets the target amount At of the inter-path shift amount and the target amounts Bt of the inter-group shift amounts so that the device specific shift amount I is equal to one target amount At of the inter-path shift amount plus the target amounts Bt of the inter-group shift amounts of nozzle groups of the number of nozzle groups−1 (that is, the number N−1).

In this embodiment, the controller 60 sets a target amount Bt of the inter-group shift based on Expression (1) as follows:

$$Bt = \frac{I}{N} + \frac{C}{N} = \frac{A + B_{ALL}}{N} + \frac{C}{N} = \frac{A + \sum_{i=1}^{N-1} B_i}{N} + \frac{C}{N} \tag{1}$$

Character C in the right term in Expression (1) is the variation amount C included in the variation amount information 83 stored in the memory 62. The target amount Bt of the inter-group shift amount is determined to further satisfy Expression (2) as follows:

$$Bt > \frac{I}{N} = \frac{A + B_{ALL}}{N} = \frac{A + \sum_{i=1}^{N-1} B_i}{N} \tag{2}$$

In this embodiment, the sum total $B_{ALL}$ of the inter-group shift amounts represents one inter-group shift amount $B_1$ between the first nozzle group 21 and the second nozzle group 22, included in the inter-group shift amount information 82 stored in the memory 62. Also, character A in the right term of Expression (2) is the inter-path shift amount A included in the inter-path shift amount information 81 held in the memory 62. Character N in the right term of Expression (2) is the number of nozzle groups, the number which is two in this embodiment. If the number N of nozzle groups is three or larger, the number of the areas between the groups is two or more. The same target amount Bt of the inter-group shift amount is set for all inter-group shifts. However, if the number N of nozzle groups is three or larger, different target amounts may be set respectively for the inter-group shifts.

Also, when the target amount Bt of the inter-group shift amount is set as aforementioned Expression (1), a target amount At of the inter-path shift amount is set by Expression (3) as follows.

$$At = \frac{I}{N} - \frac{(N-1)\cdot C}{N} = \frac{A + B_{ALL}}{N} - \frac{(N-1)\cdot C}{N} = \frac{A + \sum_{i=1}^{N-1} B_i}{N} - \frac{(N-1)\cdot C}{N} \quad (3)$$

The controller 60 of this embodiment determines the ejection timing for each nozzle group so that the target amount Bt of the inter-group shift amount and the target amount At of the inter-path shift amount satisfy aforementioned Expressions (1) and (3). Accordingly, an image shift in the main scanning direction of each path can be decreased.

The target amount At of the inter-path shift amount and the target amount Bt of the inter-group shift amount set in the ejection timing determination processing S3 may be stored in the memory 62 in a restorable manner. For example, if the target amount At is not stored, At may be restored or re-determined from the target amount Bt. The opposite is also true: Bt may be determined or restored from At. Information relating to the target amount At of the inter-path shift amount and information relating to the target amount Bt of the inter-group shift amount stored in the memory 62 are respectively stored as, for example, the latest inter-path shift amount information 81*n* and the latest inter-group shift amount information 82*n*, and may be used in next and later print processing. Alternatively, only one of the information relating to the target amount At of the inter-path shift amount and the information relating to the target amount Bt of the inter-group shift amount may be stored in the memory 62.

Hereinafter, the target amount At of the inter-path shift amount and the target amount Bt of the inter-group shift amount set in the ejection timing determination processing S3, and the inter-path shift amount Am and the inter-group shift amount Bm that may be actually generated in the image formation processing S6 are described with reference to specific examples.

Processing Example 1

Figure 8B:
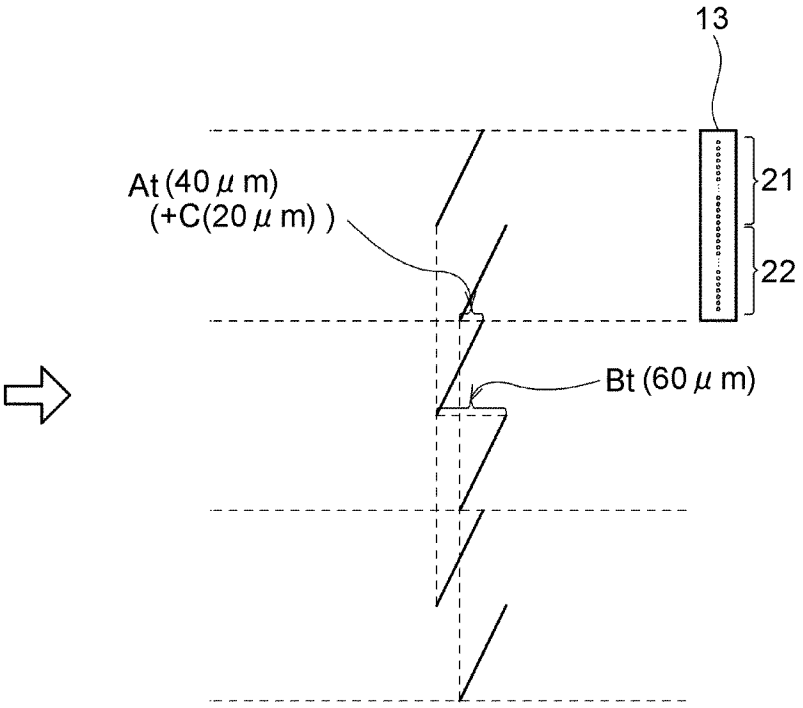
FIGS. 8A and 8B are views illustrating an example of ejection timing determination processing executed by the controller.
Figure 8A:
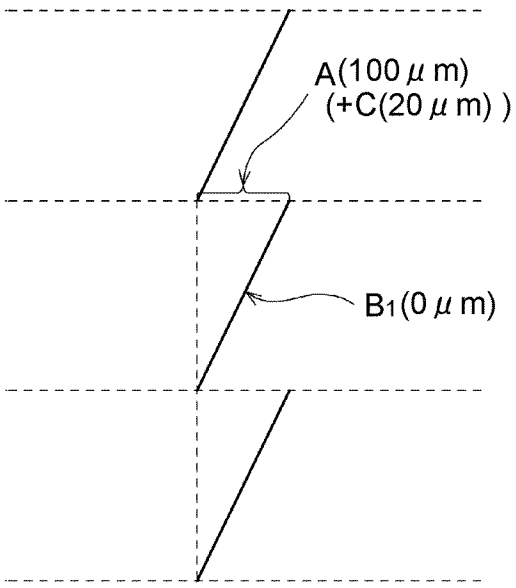

For example, FIGS. 8A and 8B are views for describing a processing example when the information 81 to 83 indicative of that the inter-path shift amount A is 100 μm, the inter-group shift amount $B_1$(B) is 0 μm, and the variation amount C is 20 μm are stored in the memory 62. In this case, the device specific shift amount I is 100 μm ($A+B_{ALL}$=100 μM+0 μm). FIG. 8A is a ruled-line image expected to be formed on a recording medium P before the ejection timing determination processing of this embodiment is executed. FIG. 8B is a ruled-line image expected to be formed on a recording medium P if the ejection timing determination processing of this embodiment is executed.

As shown in FIG. 8A, before the ejection timing determination processing of this embodiment is executed, the inter-path shift amount A is 100 μm and the variation amount C is 20 μm. Hence, the inter-path shift amount Am that may be actually generated may vary within a range from 80 μm to 120 μm for each path. That is, the maximum estimated amount of the inter-path shift amount Am that may be actually generated in FIG. 8A is 120 μm.

In this case, the controller 60 determines an ejection timing of liquid droplets for each of the nozzle groups 21 and 22 so that the target amount Bt of the inter-group shift amount and the target amount At of the inter-path shift amount satisfy aforementioned Expressions (1) and (3) on the basis of the information 81 to 83 stored in the memory 62 in the ejection timing determination processing S3. The target amount Bt of the inter-group shift amount and the target amount At of the inter-path shift amount set at this time are as follows.

$$Bt = \frac{I}{N} + \frac{C}{N} = \frac{A + B_{ALL}}{N} + \frac{C}{N} = \frac{100+0}{2} + \frac{20}{2} = 60(\mu m) \quad (4)$$

$$At = \frac{I}{N} - \frac{(N-1)\cdot C}{N} = \frac{A + B_{ALL}}{N} - \frac{(N-1)\cdot C}{N} = \frac{100+0}{2} - \frac{(2-1)\cdot 20}{2} = 40(\mu m) \quad (5)$$

FIG. 8B shows that the target amount At of the inter-path shift amount is 40 μm and the target amount Bt of the inter-group shift amount is 60 μm, which are set in the ejection timing determination processing S3. However, the inter-path shift amount Am that may be actually generated in the image formation processing S6 may be different from the target amount At of the inter-path shift amount (40 μm) because the positional relationship between the ejecting head 13 and the recording medium P varies due to the scanning operation, the medium conveying operation, or other operation, as described above. The maximum estimated amount of the inter-path shift amount Am that may be actually generated is 60 μm in which the variation C (20 μm) is added to the target amount At of the inter-path shift amount (40 μm). In contrast, the inter-group shift amount Bm that is actually generated is almost not influenced by the scanning operation (e.g., the intergroup shift might not be affected by paper shift), the medium conveying operation, or other operation, and hence is a shift amount substantially equivalent to the target amount (that is, Bm≈Bt=60 μm).

As described above, by the above-described ejection timing determination processing, the maximum estimated amount of the inter-path shift amount Am that may be actually generated is 60 μm. This is a value decreased from the maximum estimated amount of 120 μm before the execution of the ejection timing determination processing. In contrast, the inter-group shift amount Bm that is actually generated is the shift amount of 60 μm equivalent to the target amount. In this way, since the maximum value of the shift appearing in the image to be formed is decreased, the image shift is hardly recognized.

Processing Example 2

Figure 9B:
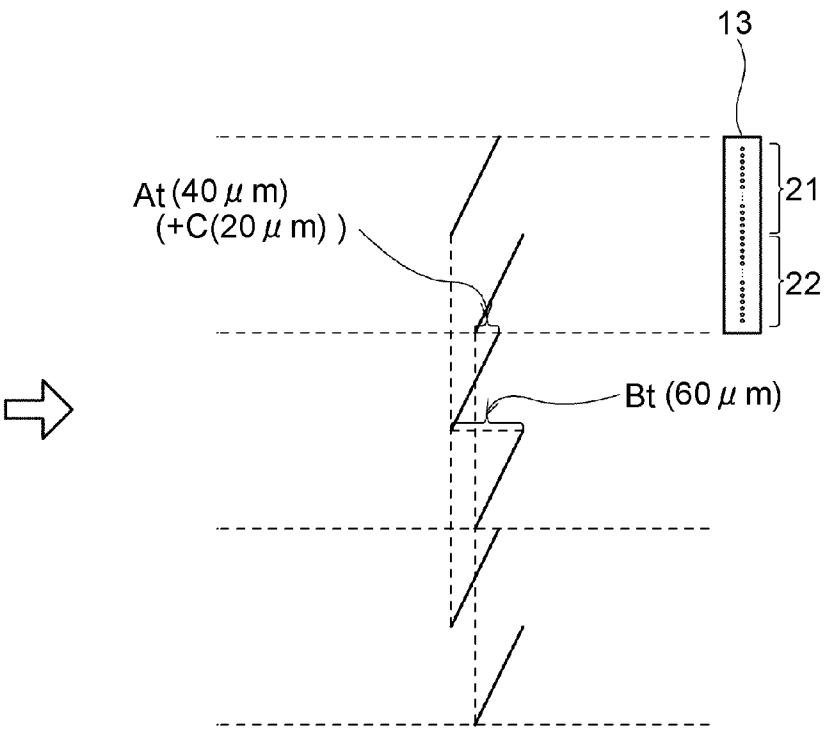
FIGS. 9A and 9B are views illustrating an example of ejection timing determination processing different from the example shown in FIGS. 8A and 8B.
Figure 9A:
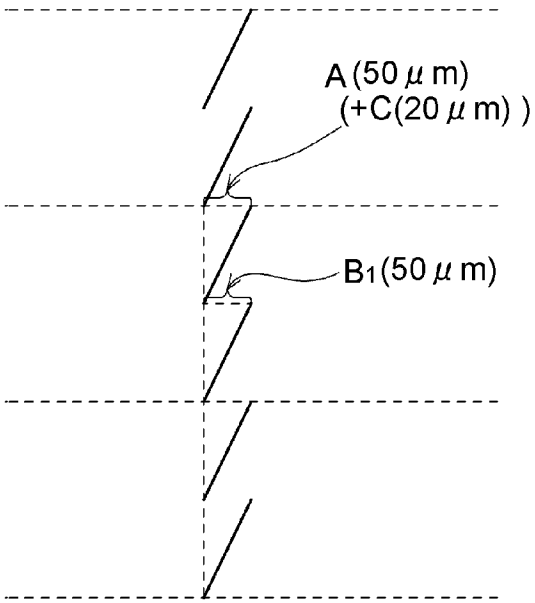

FIGS. 9A and 9B are views for describing a processing example if the inter-group shift amount B included in the inter-group shift amount information 82 is not 0 unlike in processing example 1. FIG. 9A is a ruled-line image expected to be formed on a recording medium P before the ejection timing determination processing of this embodiment is executed. FIG. 9B is a ruled-line image expected to be formed on a recording medium P if the ejection timing determination processing of this embodiment is executed. The memory 62 stores the information 81 to 83 indicative of that the inter-path shift amount A is 50 μm, the inter-group shift amount $B_1$(B) is 50 μm, and the variation amount C is 20 μm (see FIG. 9A). The device specific shift amount I in this case is also 100 μm ($A+B_{ALL}$=50 μm+50 μm) similarly to the processing example 1. The processing example 2 is executed, for example, when the information 81 to 83 stored in the controller 60 are replaced with the latest information at a time of maintenance or the like.

As shown in FIG. 9A, before the ejection timing determination processing of this embodiment is executed, the inter-path shift amount A is 50 μm and the variation amount C is 20 μm. Hence, the inter-path shift amount Am that may be actually generated may vary within a range from 30 μm to 70 μm for each path. That is, the maximum estimated amount of the inter-path shift amount Am that may be actually generated in FIG. 9A is 70 μm.

In this case, the controller 60 determines an ejection timing of liquid droplets for each of the nozzle groups 21 and 22 so that the target amount Bt of the inter-group shift amount and the target amount At of the inter-path shift amount satisfy aforementioned Expressions (1) and (3) on the basis of the information 81 to 83 stored in the memory 62 in the ejection timing determination processing S3. The target amount Bt of the inter-group shift amount and the target amount At of the inter-path shift amount set at this time are as follows.

$$Bt = \frac{I}{N} + \frac{C}{N} = \frac{A + B_{ALL}}{N} + \frac{C}{N} = \frac{50+50}{2} + \frac{20}{2} = 60(\mu m) \quad (6)$$

$$At = \frac{I}{N} - \frac{(N-1)\cdot C}{N} = \frac{A + B_{ALL}}{N} - \frac{(N-1)\cdot C}{N} = \frac{50+50}{2} - \frac{(2-1)\cdot 20}{2} = 40(\mu m) \quad (7)$$

FIG. 9B shows that the target amount At of the inter-path shift amount is 40 μm and the target amount Bt of the inter-group shift amount is 60 μm which are set in the ejection timing determination processing S3. In this processing example 2, similarly to the processing example 1, the maximum estimated amount of the inter-path shift amount Am that may be actually generated is 60 μm in which the variation C (20 μm) is added to the target amount At of the inter-path shift amount (40 μm). In contrast, the inter-group shift amount Bm that is actually generated is almost not influenced by the scanning operation, the medium conveying operation, or other operation, and hence is a shift amount substantially equivalent to the target amount (that is, Bm≈Bt=60 μm).

As described above, also in the processing example 2, by the above-described ejection timing determination processing, the maximum estimated amount of the inter-path shift amount Am that may be actually generated is 60 μm. This is a value decreased from the maximum estimated amount of 70 μm before the execution of the ejection timing determination processing. In contrast, the inter-group shift amount Bm that is actually generated is the shift amount of 60 μm equivalent to the target amount. In this way, since the maximum value of the shift appearing in the image to be formed is decreased, the image shift is hardly recognized.

As described above, in the liquid ejection device 1 of this embodiment, the controller 60 determines the ejection timing so that the target amount Bt of the inter-group shift amount is larger than the target amount At of the inter-path shift amount when determining the ejection timing of liquid droplets for each of the nozzle groups 21 and 22 arranged in the sub-scanning direction. Accordingly, even if the positional relationship between the ejecting head 13 and the recording medium P varies due to the scanning operation, the medium conveying operation, or other operation, the inter-path shift amount Am that may be actually generated can be suppressed at a relatively small value. In contrast, the inter-group shift amount Bm that is actually generated is almost not influenced by the scanning operation, the medium conveying operation, or other operation, and hence is a shift amount substantially equivalent to the target amount Bt. In this way, the maximum image shift in the image formed on the recording medium P can be decreased.

Also, in this embodiment, the controller 60 stores the variation amount information 83 relating to the variation amount C. The controller 60 sets the target amount Bt of the inter-group shift amount like aforementioned Expression (1) by using the device specific shift amount I and the variation amount C. Accordingly, the inter-path shift amount Am that may be actually generated can be suppressed at a small value, and the actual inter-group shift amount Bm can be suppressed at a value as small as possible.

Modification

The configuration of the liquid ejection device 1 does not have to be the configuration described in the embodiment and various modifications can be made. For example, the nozzle groups of the nozzles 20 formed at the ejecting head 13 may be three or more nozzle groups each having two or more nozzles. For example, if the ejecting head 13 has a number N of nozzle groups, in the ejection timing determination processing S3, the controller 60 determines an ejection timing so that a target amount Bt of an inter-group shift amount is larger than a target amount At of an inter-path shift amount. The target amount At of the inter-path shift amount is a shift amount in the main scanning direction between a first image formed by a first nozzle group in the medium conveying direction in a first path formed on a recording medium P and a second image formed by an N-th nozzle group in the medium conveying direction in the next path (e.g., a second path) formed at a position adjacent to the first image in the sub-scanning direction. The target amount Bt of the inter-group shift amount is a shift amount in the main scanning direction between an image portion of the second image formed by a K-th (1≤K≤N−1) nozzle group in the medium conveying direction and an image portion formed by a K+1-th nozzle group in the second image.

Figure 10B:
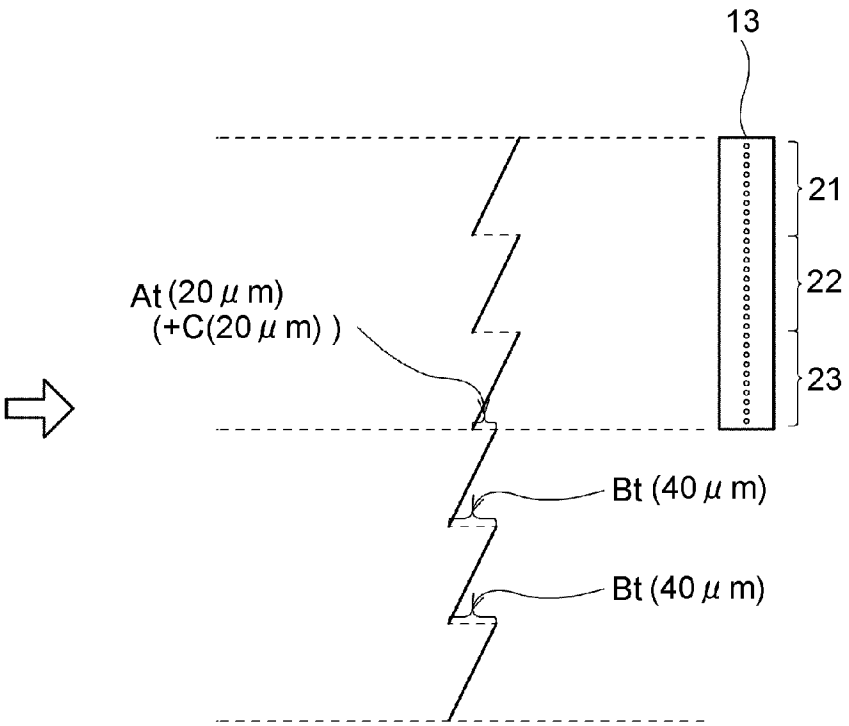
FIGS. 10A and 10B each are views illustrating an example of ejection timing determination processing in a liquid ejection device according to a modification.
Figure 10A:
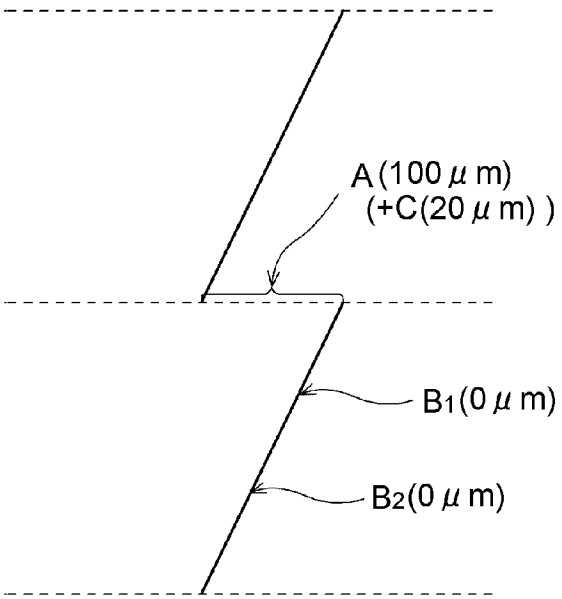

As a specific example, FIGS. 10A and 10B show an example of processing of the controller 60 when the nozzles 20 configure three nozzle groups (a first nozzle group 21, a second nozzle group 22, and a third nozzle group 23) in the sub-scanning direction. The first nozzle group 21, second nozzle group 22, and third nozzle group 23 are driven by respective different head driver ICs (not shown). The controller 60 determines an ejection timing of liquid droplets for each of the nozzle groups 21 to 23.

FIG. 10A is a ruled-line image expected to be formed on a recording medium P before the ejection timing determination processing of this embodiment is executed. FIG. 10B is a ruled-line image expected to be formed on a recording medium P if the ejection timing determination processing of this embodiment is executed. The memory 62 stores the information 81 to 83 indicative of that the inter-path shift amount A is 100 μm, the inter-group shift amount $B_1$ between the first nozzle group 21 and the second nozzle group 22 is 0 μm, an inter-group shift amount $B_2$ between the second nozzle group 22 and the third nozzle group 23 is 0 μm, and the variation amount C is 20 μm (see FIG. 10A). The device specific shift amount I in this case is also 100 μm ($A+B_{ALL}$=100 μm+0 μm) similarly to the processing examples 1 and 2.

As shown in FIG. 10A, similarly to the processing example 1, before the ejection timing determination processing of this embodiment is executed, the inter-path shift amount A is 100 μm and the variation amount C is 20 μm. Hence, the inter-path shift amount Am that may be actually generated may vary within a range from 80 μm to 120 μm for each path. That is, the maximum estimated amount of the inter-path shift amount Am that may be actually generated in FIG. 10A is 120 μm.

In this case, the controller 60 determines an ejection timing of liquid droplets for each of the nozzle groups 21 to 23 so that the target amount Bt of the inter-group shift amount and the target amount At of the inter-path shift amount satisfy aforementioned Expressions (1) and (3) on the basis of the information 81 to 83 stored in the memory 62 in the ejection timing determination processing S3. The target amount Bt of the inter-group shift amount and the target amount At of the inter-path shift amount set at this time are as follows.

$$Bt = \frac{I}{N} + \frac{C}{N} = +\frac{A + B_{ALL}}{N} + \frac{C}{N} = \frac{100+0+0}{3} + \frac{20}{3} = 40(\mu m) \quad (8)$$

$$At = \frac{I}{N} - \frac{(N-1)\cdot C}{N} = \frac{A + B_{ALL}}{N} - \frac{(N-1)\cdot C}{N} = \frac{100+0+0}{3} - \frac{(3-1)\cdot 20}{3} = 20(\mu m) \quad (9)$$

The maximum estimated amount of the inter-path shift amount Am that may be actually generated is 40 μm in which the variation C (20 μm) is added to the target amount At of the inter-path shift amount (20 μm). In contrast, the inter-group shift amount Bm that is actually generated is almost not influenced by the scanning operation, the medium conveying operation, or other operation, and hence is a shift amount substantially equivalent to the target amount (that is, Bm≈Bt=40 μm).

As described above, by the above-described ejection timing determination processing, the maximum estimated amount of the inter-path shift amount Am that may be actually generated is 40 μm. This is a value decreased from the maximum estimated amount of 120 μm before the execution of the ejection timing determination processing. In contrast, the inter-group shift amount Bm that is actually generated is the shift amount of 40 μm equivalent to the target amount. Also in this modification, the advantageous effect similar to that of the above-described embodiment can be attained. Even when information different from the above-described information 81 to 83 is stored in the memory 62 of the liquid ejection device 1 according to this modification, a similar advantageous effect can be attained.

Other Embodiments

The above-described embodiment is merely an example in all points of view, and it should be understood that the invention is not limited to the embodiment. The scope of the invention is not defined by the above description, but is defined by the claims. It is intended to include meanings equivalent to the claims and all modifications within the scope.

For example, the numerical values such as the inter-path shift amount A described above are exemplarily described for understanding the invention, and hence are not limited to the above-described numerical values.

Also, the controller 60 does not have to set an ejection timing so that the target amount Bt of the inter-group shift amount and the target amount At of the inter-path shift amount satisfy aforementioned Expressions (1) and (3) in the ejection timing determination processing S3. Instead, the controller 60 may set an ejection timing to satisfy at least aforementioned Expression (2) (with or without satisfying Expressions (1) and (3)).

In some examples, the target amount Bt of the inter-group shift amount is desirably set to satisfy Expression (2), and in addition, to suppress the actually generated inter-group shift amount Bm at a recognizable level (e.g., discernible to the human eye). For example, in the ejection timing determination processing S3, the controller 60 may set the target amount Bt of the inter-group shift amount to be smaller than the distance between adjacent dots based on the print resolution of the liquid ejection device 1. Accordingly, the actual inter-path shift amount Am is smaller than one dot. As compared with a shift amount of one dot or more, the shift between dots can be suppressed at a non-recognizable level.

The above-described liquid ejection device 1 can be applied to a liquid ejection device of an unidirectional print system that ejects liquid droplets from the ejecting head 13 only in forward scanning when the carriage 12 moves in the main scanning direction, and a liquid ejection device of bidirectional print system that ejects liquid droplets from the ejecting head 13 in forward scanning and backward scanning when the carriage 12 moves in the main scanning direction.

Also, in the above-described embodiment, the controller 60 executes predetermined ejection timing determination processing of liquid droplets for each of the nozzle groups. However, the controller 60 may execute another processing depending on print data. For example, the controller 60 may execute another ejection timing determination processing of determining a single ejection timing for all the plurality of nozzles 20 of the ejecting head 13 on the basis of print data.

If the liquid ejection device 1 includes the waveform applying mechanism 37 like the above-described embodiment, the distance to the recording medium P may be different between the nozzle groups 21 and 22. Determining the ejection timing of liquid droplets as described above is particularly useful. However, the liquid ejection device of the present invention does not have to include the waveform applying mechanism, and the invention can be applied to any liquid ejection device having different distances between the respective nozzles arranged in the sub-scanning direction and the recording medium. For example, aspects described herein may be applied to a liquid ejection device having a difference in distance to the recording medium among the nozzles due to, for example, the inclination of the platen or the inclination of the nozzle surface of the ejecting head possibly generated in assembling, or a difference in height between the convey roller unit and the discharge roller unit.

Also, the controller 60 may determine an ejection timing so that a second target amount is changed depending on whether a trailing edge of a recording medium P passes the convey roller unit 33 or not. For example, if the controller 60 determines that the trailing edge of a recording medium P has not passed the convey roller unit 33, the controller 60 may set the second target amount to first value. If, on the other hand, the controller 60 determines that the trailing edge of a recording medium P has passed (or is passing) the convey roller unit 33, the controller 60 may set the second target amount to second value which is greater than the first value.

Also, the above-described embodiment provides an example configured to be able to execute a path print mode in which the controller 60 executes first image formation processing of forming a first image for one path by using all the number N of nozzle groups, then executes convey processing of conveying a recording medium P by the convey mechanism by a predetermined amount (for one path), and then executes second image formation processing of forming a second image adjacent to the first image by using all the number N of nozzle groups. However, aspects described herein may be applied to, for example, a case configured to be able to execute an interlace print mode in which the controller 60 executes first image formation processing of forming a first image by using a portion of the number N of nozzle groups in one-time scanning with the ejecting head 13, then without conveyance of a recording medium P with the convey mechanism, executes second image formation processing of forming a second image adjacent to the first image by using another portion of the number N of nozzle groups in the next scanning with the ejecting head 13.

For example, the controller 60 may cause the ejecting head 13 to eject liquid droplets at the ejection timing determined in the ejection timing determination processing S3 by using a number S ($N>S\geq1$) of nozzle groups among the number N of nozzle groups while causing the ejecting head 13 to perform scanning in the main scanning direction to form a first image on a recording medium P (S6*a*) (corresponding to first image formation processing according to the invention), and then, without conveyance of the recording medium by the convey mechanism, may cause the ejecting head 13 to eject liquid droplets at the ejection timing determined by the ejection timing determination processing S3 by using a number T ($N>T\geq2$) of nozzle groups among the number N of nozzle groups to form a second image at the position adjacent to the first image in the sub-scanning direction on the recording medium P (S6*b*) (corresponding to second image formation processing according to the invention). In this case, in the ejection timing determination processing S3, the controller 60 determines an ejection timing so that a second target amount being a target value of a second shift amount in the main scanning direction between a portion formed by a K-th ($1\leq K\leq T-1$) nozzle group and a portion formed by a K+1-th nozzle group in the second image is larger than a first target amount being a target value of a first shift amount in the main scanning direction between a portion formed by a first nozzle group in the sub-scanning direction in the first image and a portion formed by a T-th nozzle group in the sub-scanning direction in the second image. In this case, the nozzle groups that form the second image may be a number N−S of nozzle groups (that is, T=N−S).

As described above, even when an image is formed on a recording medium P by using a portion of the number N of nozzle groups included in the ejecting head 13, even if the first shift amount varies with respect to the target amount, the first shift amount that is actually generated can be suppressed at a relatively small value. In contrast, since the second shift amount is almost not influenced by the scanning operation, the medium conveying operation, or other operation, the second shift amount that is actually generated is substantially equivalent to the target amount. In this way, the maximum image shift in the image formed on the recording medium can be decreased.

What is claimed is:

1. A liquid ejection device configured to print an image on a medium, the liquid ejection device comprising:

a carriage configured to reciprocate in a main scanning direction;

an ejection head mounted on the carriage, the ejection head having a plurality of nozzle groups, the plurality of nozzle groups arranged in a sub-scanning direction intersecting the main scanning direction, each of the plurality of nozzle groups including one nozzle or two or more nozzles arranged adjacent to each other, wherein the ejection head is configured to:

form a first image in a first area of the medium, the first image being formed in a single pass by the ejection head in the main scanning direction, and form a second image in a second area of the medium adjacent to the first area of the medium in the sub-scanning direction, the second image being formed by the ejection head in a single pass in the main scanning direction;

a controller; and memory storing computer readable instructions that, when executed, cause the controller to:

determine a target first deviation amount in the main scanning direction between the first image and the second image;

determine a target second deviation amount in the main scanning direction between an area to be printed by a first nozzle group of the plurality of nozzle groups and an area to be printed by a second nozzle group adjacent to the first nozzle group, the area to be printed by the first nozzle group and the area to be printed by the second nozzle group corresponding to a same single pass of the ejection head, wherein the target first deviation amount is smaller than the target second deviation amount; and when printing the first image on the first area of the medium and the second image on the second area adjacent to the first area in the sub-scanning direction:

determine a respective ejection timing for each of the plurality of nozzle groups based on at least one of the target first deviation amount and the target second deviation amount; and form, by controlling the plurality of nozzle groups, the first image and the second image using the determined ejection timings.

2. The liquid ejection device of claim 1, wherein the first image and the second image are formed based on received image data, wherein the received image data defines at least one portion of the first image being continuous with at least a portion of the second image.

3. The liquid ejection device of claim 1, wherein the target second deviation amount corresponds to a distance, in the main scanning direction, between a point to be printed by a most upstream nozzle of the first nozzle group and a point to be printed by a most downstream nozzle of the second nozzle group.

4. The liquid ejection device of claim 1, wherein the controller is configured to determine a same ejection timing of all of the plurality of nozzle groups based on the target first deviation amount and the target second deviation amount.

5. The liquid ejection device of claim 1, further comprising a conveyance mechanism disposed upstream of the ejection head in the sub-scanning direction and configured to convey the medium in the sub-scanning direction, wherein the controller is configured to:

determine whether a trailing edge of the medium being conveyed in the sub-scanning direction by the conveyance mechanism has passed the conveyance mechanism;

set the target second deviation amount to a first value based on the determination when the trailing edge of the medium does not pass the conveyance mechanism; and set the target second deviation amount to a second value greater than the first value based on the determination when the trailing edge passes the conveyance mechanism.

6. The liquid ejection device of claim 1, wherein the target second deviation amount is equal to or less than 60 um.

7. A liquid ejection device configured to print an image on a medium, the liquid ejection device comprising:

a carriage configured to reciprocate in a main scanning direction;

an ejection head mounted on the carriage, the ejection head having a plurality of nozzle groups, the plurality of nozzle groups arranged in a sub-scanning direction intersecting the main scanning direction, each of the plurality of nozzle groups including one nozzle or two or more nozzles arranged adjacent to each other, wherein the ejection head is configured to:

form a first image in a first area of the medium, the first image being formed in a single pass by the ejection head in the main scanning direction, and form a second image in a second area of the medium adjacent to the first area of the medium in the sub-scanning direction, the second image being formed by the ejection head in a single pass in the main scanning direction;

a controller; and memory storing computer readable instructions that, when executed, cause the controller to:

determine a target first deviation amount in the main scanning direction between the first image and the second image, wherein determining the target first deviation amount includes calculating the target first deviation amount based on a device deviation amount and a total number of nozzle groups;

determine a target second deviation amount in the main scanning direction between an area to be printed by a first nozzle group of the plurality of nozzle groups and an area to be printed by a second nozzle group adjacent to the first nozzle group, the area to be printed by the first nozzle group and the area to be printed by the second nozzle group corresponding to a same single pass of the ejection head, wherein the target first deviation amount is smaller than the target second deviation amount; and when printing the first image on the first area of the medium and the second image on the second area adjacent to the first area in the sub-scanning direction:

determine a respective ejection timing for each of the plurality of nozzle groups based on at least one of the target first deviation amount and the target second deviation amount; and form, by controlling the plurality of nozzle groups, the first image and the second image using the determined ejection timings.

8. The liquid ejection device of claim 1, further comprising a conveyance mechanism configured to convey the medium in the sub-scanning direction, wherein the controller is configured to control the conveyance mechanism to convey the medium after forming the first image and before forming the second image, and wherein the controller is configured to control the ejection head to print the first image and the second image by using all of the plurality of nozzle groups.

9. A liquid ejection device configured to print an image on a medium, the liquid ejection device comprising:

a carriage configured to reciprocate in a main scanning direction;

an ejection head mounted on the carriage, the ejection head having a N nozzle groups, where N is four or greater, the N nozzle groups arranged in a sub-scanning direction intersecting the main scanning direction, each of the N nozzle groups including one nozzle or two or more nozzles arranged adjacent to each other, wherein the ejection head is configured to:

form a first image in a first area of the medium, the first image being formed in a single pass by the ejection head in the main scanning direction, and form a second image in a second area of the medium adjacent to the first area of the medium in the sub-scanning direction, the second image being formed by the ejection head in a single pass in the main scanning direction;

a conveyance mechanism configured to convey the medium in the sub-scanning direction;

a controller; and memory storing computer readable instructions that, when executed, cause the controller to:

determine a target first deviation amount in the main scanning direction between the first image and the second image;

determine a target second deviation amount in the main scanning direction between an area to be printed by a first nozzle group of the N nozzle groups and an area to be printed by a second nozzle group adjacent to the first nozzle group, the area to be printed by the first nozzle group and the area to be printed by the second nozzle group corresponding to a same single pass of the ejection head, wherein the target first deviation amount is smaller than the target second deviation amount; and when printing the first image on the first area of the medium and the second image on the second area adjacent to the first area in the sub-scanning direction:

determine a respective ejection timing for each of the N nozzle groups based on at least one of the target first deviation amount and the target second deviation amount; and form, by controlling the N nozzle groups, the first image and the second image using the determined ejection timings, including performing an interlace print process, the interlace print process including forming the second image, after forming the first image, without conveying the medium by the conveyance mechanism, and wherein the controller is configured to:

print the first image using S nozzle groups, wherein S is less than N, and wherein the S nozzle groups are continuously arranged with each other at one side of the N nozzle groups in the sub-scanning direction, and print the second image using T nozzle groups, T being equal to a difference between N and S, the T nozzle groups being continuously arranged with each other at another side of the N nozzle groups in the sub-scanning direction.

10. A liquid ejection device configured to print an image on a medium, the liquid ejection device comprising:

a carriage configured to reciprocate in a main scanning direction;

an ejection head mounted on the carriage, the ejection head having a plurality of nozzle groups including a first nozzle group, a second nozzle group and a third nozzle group, the plurality of nozzle groups arranged in a sub-scanning direction intersecting the main scanning direction, each of the plurality of nozzle groups including one nozzle or two or more nozzles arranged adjacent to each other, wherein the ejection head is configured to:

form a first image in a first area of the medium, the first image being formed in a single pass by the ejection head in the main scanning direction, and form a second image in a second area of the medium adjacent to the first area of the medium in the sub-scanning direction, the second image being formed by the ejection head in a single pass in the main scanning direction;

a conveyance mechanism configured to convey the medium in the sub-scanning direction;

a controller; and memory storing computer readable instructions that, when executed, cause the controller to:

determine a target first deviation amount in the main scanning direction between the first image and the second image;

determine a target second deviation amount in the main scanning direction between an area to be printed by the first nozzle group of the plurality of nozzle groups and an area to be printed by the second nozzle group adjacent to the first nozzle group, the area to be printed by the first nozzle group and the area to be printed by the second nozzle group corresponding to a same single pass of the ejection head, wherein the target first deviation amount is smaller than the target second deviation amount; and when printing the first image on the first area of the medium and the second image on the second area adjacent to the first area in the sub-scanning direction:

determine a respective ejection timing for each of the plurality of nozzle groups based on at least one of the target first deviation amount and the target second deviation amount; and form, by controlling the plurality of nozzle groups, the first image and the second image using the determined ejection timings, wherein the controller is configured to control the ejection head to print the first image and the second image by using all of the plurality of nozzle groups, and the controller is configured to control the conveyance mechanism to convey the medium after forming the first image and before forming the second image, wherein a first preset second deviation amount is defined for the first and second nozzle groups and a second preset second deviation amount is defined for the second and third nozzle groups, and wherein the memory stores a device deviation amount corresponding to a preset first deviation amount added to a sum of the first and second preset second deviation amounts, wherein the preset first deviation amount, and the first and second preset second deviation amounts are attributed to an ejection head orientation relative to a platen configured to support the medium.

11. The liquid ejection device of claim 10, wherein the target second deviation amount is greater than the device deviation amount divided by N, and wherein N is a total number of the plurality of nozzle groups.

12. The liquid ejection device of claim 11, wherein the memory stores information related to an estimated amount, the estimated amount being a difference between a maximum potential first deviation amount and the preset first deviation amount, the maximum potential first deviation amount being a maximum deviation in the main scanning direction between a portion of the first image printed by using an upstream-most nozzle group of the plurality of nozzle groups in the sub-scanning direction and a portion of the second image printed by using a downstream-most nozzle group of the plurality of nozzle groups in the sub-scanning direction, and wherein the target second deviation amount is equal to a deviation amount sum divided by the number of nozzle groups, the deviation amount sum being equal to the device deviation amount plus the estimated amount.

13. The liquid ejection device of claim 10, wherein the memory stores one of information related to the preset first deviation amount and information related to the first and second preset second deviation amounts prior to receiving an instruction to print the first image and the second image.

14. A method for forming an image on a medium, the method comprising:

determining a target first deviation amount in a main scanning direction between a first image and a second image to be formed by an ejection head of a liquid ejection device, the ejection head configured to form the first image in a first area of the medium in a single pass in the main scanning direction of the ejection head, the ejection head configured to form the second image in a single pass in a second area of the medium adjacent to the first area of the medium in a sub-scanning direction;

determining a target second deviation amount in the main scanning direction between an area to be printed by a first nozzle group of a plurality of nozzle groups of the ejection head and an area to be printed by a second nozzle group adjacent to the first nozzle group, the area to be printed by the first nozzle group and the area to be printed by the second nozzle group corresponding to a same single pass of the ejection head, wherein the target first deviation amount is smaller than the target second deviation amount;

when printing the first image on the first area of the medium and the second image on the second area adjacent to the first area in the sub-scanning direction:

determine a respective ejection timing for each of the plurality of nozzle groups based on at least one of the target first deviation amount and the target second deviation amount; and form, by controlling the plurality of nozzle groups, the first image and the second image using the determined ejection timings.

* * * * *